US005247830A

United States Patent [19]

Goode

[11] Patent Number: 5,247,830

[45] Date of Patent: Sep. 28, 1993

[54] METHOD FOR DETERMINING HYDRAULIC PROPERTIES OF FORMATIONS SURROUNDING A BOREHOLE

[75] Inventor: Peter A. Goode, Newtown, Conn.

[73] Assignee: Schlumberger Technology Corporation, New York, N.Y.

[21] Appl. No.: 761,214

[22] Filed: Sep. 17, 1991

[51] Int. Cl.[5] ..... E21B 49/00

[52] U.S. Cl. ..... 73/155

[58] Field of Search ..... 73/155, 151, 38, 152

[56] References Cited

U.S. PATENT DOCUMENTS 2,747,401 5/1956 Doll ..... 73/151

*Primary Examiner*—Hezron E. Williams
*Assistant Examiner*—Michael Brock
*Attorney, Agent, or Firm*—David P. Gordon; Marc D. Foodman; Leonard W. Pojunas

[57] ABSTRACT

Methods for determining hydraulic properties of a formation surrounding a borehole are disclosed. The methods use a borehole tool preferably having a first probe for injecting fluid into a formation or obtaining fluid from the formation, a second probe vertically displaced relative to the first probe, and a third probe azimuthally displaced relative to the first probe. The method generally comprises: varying the pressure at the first probe of the borehole tool; measuring pressures at the second and third probes resulting from the varying of pressure at the first probe; and utilizing the pressures measured at the second and third probes to determine values over time of a function related to the hydraulic properties of the formation. This function is a function of the geometry and rock and fluid properties of the formation but is independent of the manner in which the pressure is varied at the first probe.

24 Claims, 13 Drawing Sheets

METHOD FOR DETERMINING HYDRAULIC PROPERTIES OF FORMATIONS SURROUNDING A BOREHOLE

BACKGROUND OF THE INVENTION

This invention relates to methods for investigating subsurface earth formations. More particularly, this invention relates to methods for determining the permeability and other hydraulic properties of earth formations surrounding boreholes.

The determination of permeability and other hydraulic properties of formations surrounding boreholes is very useful in gauging the producibility of the formations, and in obtaining an overall understanding of the structure of the formations. For the reservoir engineer, permeability is generally considered a fundamental reservoir parameter, the determination of which is at least equal in importance with the determination of porosity, fluid saturations, and formation pressure. When obtainable, cores of the formation provide important data concerning permeability. However, cores are difficult, expensive, and time consuming to obtain, and even when performed only provide information about very small samples. Thus, in situ determinations of permeability which provide logs of horizontal and vertical permeabilities at a length scale greater than that provided by cores are highly desirable.

Existing techniques for making permeability determinations can be classified into indirect and direct methods. In indirect methods, permeability is determined from empirical correlations which attempt to express permeability in terms of other measured formation parameters, such as porosity, saturation, or mineralogy. A direct measurement technique involves actual measurement of fluid flow, pressure, etc. and determination of permeability from these measurements.

Different devices have been used for making direct measurements of permeability. For example, devices whose primary use has been for sampling formation fluids, have also been used with some success in estimating formation permeability. Formation testing devices which can take repeated samples are disclosed, for example, in U.S. Pat. Nos. 3,780,575 and 3,952,588. In these devices, a hydraulic pump provides pressure for the operation of various hydraulic systems in the device. Sample chambers are provided in the tool to take samples of formation fluid by withdrawing hydraulically operated pistons. Pressure transducers are provided to monitor pressure as the fluid is withdrawn, and pressure can be continuously recorded. So-called pretest chambers are also typically provided and are operated to permit more reliable flow during the subsequent fluid withdrawal. Filters can also be provided to filter sand and other particulate matter, and pistons can be provided to clean the filters, such as when the tool is retracted.

One type of formation testing device includes an elongated body and a setting arm activated by setting pistons which are used to controllably urge the body of the device against a side of the borehole wall at a selected depth. The side of the device that is urged against the borehole wall includes a packer which surrounds a probe. As the setting arm extends, the probe is inserted against the formation, and the packer then sets the probe in position and forms a seal around the probe, whereupon the fluids can be withdrawn from the formation during pre-test and the actual test.

Existing formation sampling devices have been of limited usefulness in determining formation permeability for a number of reasons. In some instances, attempts have been made to use pressure measurements during fluid withdrawal as an indicator of permeability. If fluid is extracted at a fixed flow rate which is independent of permeability, as is typically done, in low permeability formations the pressure drop tends to be too large, and solution gas and/or water vapor forms and can make the results uninterpretable. On the other hand, at high permeabilities, the pressure drop tends to be too small and cannot be accurately measured.

In U.S. Pat. No. 2,747,401 there is disclosed a method and apparatus for determining hydraulic characteristics, including permeability, fluid pressure, and hydraulic anisotropy, of formations surrounding a borehole. A pressure gradient is obtained in the formations by inserting a probe through the borehole wall. Pressure differences between different points are then used to obtain indications of hydraulic characteristics of the formations. In an embodiment disclosed in the patent, a pair of spaced probes are inserted into the formation, and a pressure gradient is generated by inserting a fluid into the formation at one of the probes (a source probe) at a constant flow rate. The other probe (a measurement probe) is coupled to a pressure responsive device. Pressure is measured at the measurement probe before and after injection of the fluid at the source probe. The permeability of the formation is then obtained using a formula in which permeability is proportional to viscosity times flow rate divided by the change in pressure. The patent points out that the pressure gradient can also be obtained by extracting fluid from the formation and that measurements can be made in more than one direction; e.g., vertical and horizontal, to obtain indications of both vertical and horizontal hydraulic characteristics.

In improving upon the previous permeability tools, another method and apparatus for determining hydraulic properties of a formation is set forth in U.S. Pat. No. 4,742,459 to Lasseter, which is hereby incorporated by reference herein in its entirety. In the Lasseter patent, a logging device is provided having a source probe, a horizontal observation probe which is azimuthally displaced on the borehole wall with respect to the source probe position, and a vertical observation probe which is vertically displaced on the borehole wall with respect to the source probe position. The source probe is provided with means for withdrawing fluid at a substantially constant pressure, while the vertical and horizontal probes, as well as the source probe, are provided with means for measuring formation pressure response as a function of time. According to the method for determining permeability, a transient pressure change is established in the formation by withdrawing fluid from the formation at the source probe location. The formation pressure response is then measured at the vertical and horizontal probes. By selecting a trial permeability value, theoretical formation pressure responses can be derived as a function of time at the probe locations. The theoretical formation pressure responses are then compared with the actually measured pressure responses in an iterative manner, with the difference being used as feedback to modify the trial value, until the difference is negligible.

While the prior art patents, including the Lasseter patent, have had varying degrees of success in determining the hydraulic characteristics of the borehole, extremely accurate determinations over a wide range of permeabilities have not been obtainable utilizing the prior art methods. Typically, the difficulties encountered by the prior art techniques relate to the requirement of a measurement of flow rate, or the requirement that the formation fluids be withdrawn at a constant flow rate.

SUMMARY OF THE INVENTION

It is therefore an object of the invention to provide methods for accurately determining hydraulic properties of formations surrounding a borehole.

It is another object of the invention to accurately determine the permeability of a formation surrounding a borehole by utilizing a source probe and observation probes, where fluid flow rate need not be measured at any of the probes, and the source probe need not withdraw fluid at a constant flow rate.

It is a further object of the invention to accurately determine horizontal and vertical hydraulic properties of formation surrounding a borehole irrespective of the fluid flowrate obtained during withdrawal of formation fluids.

In accord with the objects of the invention, a method for accurately determining a hydraulic property of a formation surrounding a borehole broadly comprises: varying the pressure at a sink probe of a borehole tool; measuring the pressure at observation probes of the borehole tool which are vertically and horizontally displaced from the sink probe in response to the varying of pressure at the sink probe; utilizing the measured pressures at the observation probes to determine values over time of a function which is a function of the geometry and rock and fluid properties of the formation but is independent of the manner in which the pressure is varied at the sink probe; and using the function to determine the hydraulic property of the formation. The function which is a function of the geometry, rock, and fluid properties of the formation is denoted as G(t), and an integration of G(t) with respect to time yields H(t). H(t) can be calculated from the measured pressures via deconvolution. By plotting functions of H(t) (e.g., H(t) as a function of the inverse square root of time; $1/(1-H(t))$ as a function of the logarithm of time; etc.), a determination can be made as to parameters of the formation in which the tool is located (e.g., the tool is in an effectively unbounded or effectively layered formation). The slope and intercept of H(t) then relate to estimates of the horizontal and vertical diffusivities, which in turn relate to estimates of the horizontal and vertical permeability of the formation.

By using horizontal and vertical diffusivity estimates obtained via the slope and intercept of the H(t) plot, and by using estimates of other relevant parameters (such as distances to different boundaries), G(t) can be calculated and convolved with the pressure measured at the horizontal probe to generate an estimated vertical pressure (i.e., the pressure which should result at the vertical probe for the assumption of the type of formation and the diffusivities involved). The difference between the estimated vertical pressure and the measured vertical pressure is then minimized by adjusting the diffusivity and other parameters so as to provide a best fit and final determination of horizontal and vertical diffusivities as well as the other varied parameters.

With the provided methods for determining hydraulic properties, the need for measuring the flow rate at the probes is eliminated, and problems typically associated with nonlinear effects due to high flowrate at the sink and formation damage near the sink are obviated.

Additional objects and advantages of the invention will become apparent to those skilled in the art upon reference to the detailed description in conjunction with the accompanying drawings.

DETAILED DESCRIPTION OF THE PREFERRED EMBODIMENT

Figure 1:
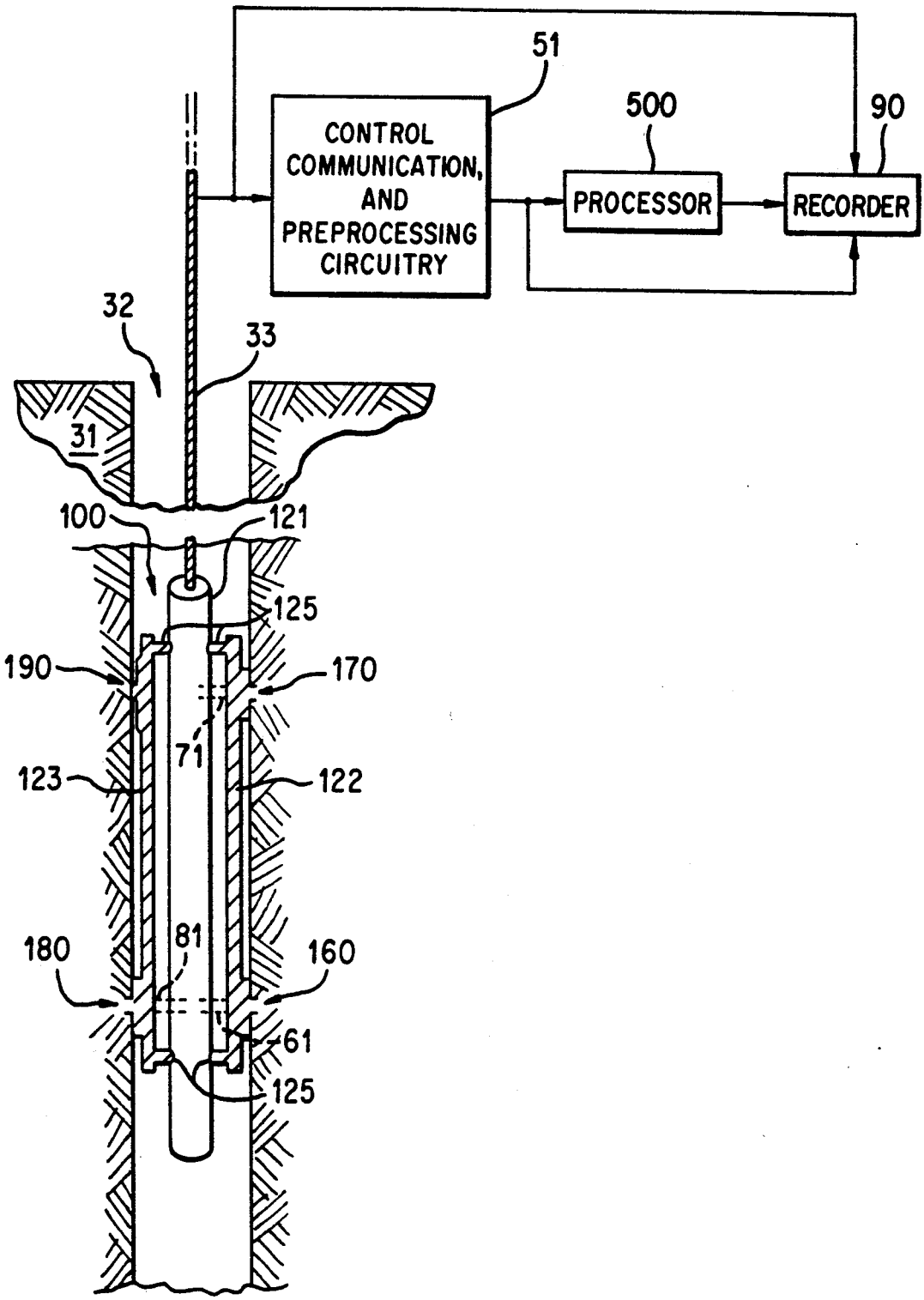
FIG. 1 is a diagram, partially in schematic form, of an apparatus in accordance with an embodiment of the invention which can be used to practice an embodiment of the method of the invention.

An apparatus 100 for investigating subsurface formations 31 traversed by a borehole 32 is seen in FIG. 1. Typically, the borehole 32 is filled with a drilling fluid or mud which contains finely divided solids in suspension. The investigating apparatus or logging device 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus depth of the logging device 100 in the borehole 32. The cable length is controlled by suitable means at the surface such as a drum and winch mechanism (not shown). Circuitry 51, shown at the surface of the formation, although portions thereof may be downhole, represents control, communication and preprocessing circuitry for the logging apparatus. This circuitry may be of known type, and is not, per se a novel feature of the present invention.

The preferred logging device 100 has an elongated body 121 which encloses the downhole portion of the device controls, chambers, measurement means, etc. Arms 122 and 123 are mounted on pistons 125 which extend, under control from the surface, to set the tool. Mounted on the arm 122 are a source probe 160, and spaced above and vertically therefrom, a vertical observation probe 170. Mounted on the arm 123 is a horizontal observation probe 180. The arm may also contain a further measuring device, such as an electrical microresistivity device at the position 190. Conduits 61, 71, and 81 are provided and are slidably mounted in body 121 for communication between the probes 160, 170, and 180, respectively, and the body 121.

As is disclosed in previously incorporated U.S. Pat. No. 4,742,459, the source probe 160 preferably comprises either a fluid sink or a fluid source which includes a packer 161 with a fluid-carrying line that communicates with the formation when the packer is set. The present invention is not dependent on use of a particular type of mechanical means for withdrawing fluid from or injecting fluid into the formations, as any of numerous such device well known in the art may be utilized.

Figure 2:
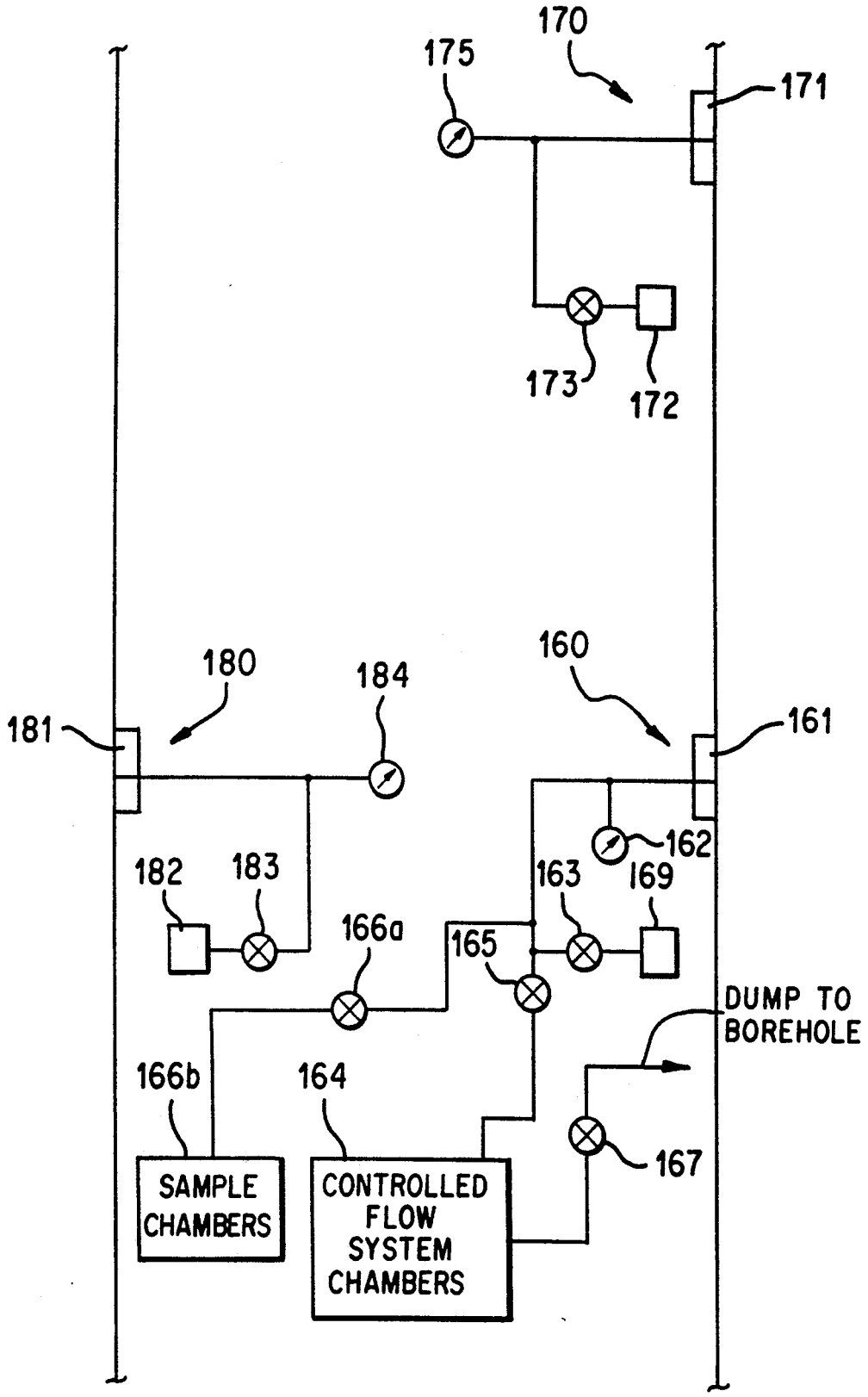
FIG. 2 is a diagram, partially in schematic form, of portions of the logging device of FIG. 1.

As seen in FIG. 2, a pretest chamber 169 is accessed via a valve 163. A controlled flow system with chambers 164 is accessible via valve 165. The control of sample dump to the borehole is via valve 167. In addition, valve **166*a* is provided along with sample chambers 166*b* to permit storage of samples to be brought to the surface of the formation. A pressure measurement device 162** such as a strain gauge type of pressure meter is provided to monitor pressure at the probe. In accord with the preferred embodiment of the invention, no flow rate meter is required as flow rate is not used in making determinations of the hydraulic properties of the formation according to the preferred embodiment of the invention.

The vertical observation probe 170 comprises a packer 171 with an observation port or probe that engages the borehole, and communicates with a pretest chamber 172 via a valve 173. A high resolution high-accuracy pressure meter 175, such as of the quartz piezoelectric type, is preferably provided to monitor the pressure at the probe. The horizontal observation probe 180 is of similar construction to the vertical observation probe and includes a packer 181 with an observation port or probe that engages the borehole, pretest chamber 182 and valve 183, and pressure measuring means 184. Despite the preference of a quartz piezoelectric type pressure meter, the present invention is not dependent on use of a particular device for taking pressure measurements, as many such devices are well known in the art.

The mechanical elements of the system are controlled from the surface of the earth hydraulically and electrically in a known fashion. Likewise, the pressure at the source probe and the observation probes are monitored and transmitted to the surface of the earth for recording in known manners.

The signal outputs of block 51 are illustrated as being available to processor 500 which, in the present embodiment, is implemented by a general purpose digital computer, such as a model Microvex II sold by Digital Equipment Corp. It will be understood, however, that a suitable special purpose digital analog computer could alternatively be employed. Also, it will be recognized that the processor may be at a remote location and receive inputs by transmission of previously recorded signals. The outputs of the computing module 500 are values or value-representative signals for formation hydraulic properties, developed in accordance with techniques described hereinbelow. These signals are recorded as a function of depth on recorder 90, which generically represents graphic, electrical and other conventional storage techniques.

In operation, at a depth level at which measurements are to be taken, the pistons 125 are extended and the tool is set. Under control from the surface, a pretest is then performed at the source probe 160 and the observation probes 170 and 180. The function of the pretest is to flush out mud from between the source and observation probes and the formation so as to ensure good hydraulic seals and communication with the formation. During pretest, the fluid lines of the borehole tool are generally flushed to remove borehole fluid and mud.

The pretest is followed by a withdrawal ("drawdown") of the formation fluids into the lines of the borehole tool. Drawdown is done at a constant flow rate if possible, and pressure measurements are typically taken at the source probe 160 and at observation probes 170 and 180. Drawdown is accomplished by opening valve 165 and initiating the pressure controlled subsystem 164 to withdraw fluid from the formation. Fluid is withdrawn or injected at a substantially controlled pressure or rate. The valve is then closed at the time designated as the shut-in time. During this time, and for a predetermined time after shut-in time, the pressure at the source probe and at each observation probe is measured by the respective pressure gauges and sent to the surface of the earth where the measured pressures are recorded. Flow due to the compression of the fluid in the tool continues following shutin. This is what is called "storage". Typically, although not necessarily, pressure signals are sampled at a period of 0.1 seconds, converted to digital form, and sent to the surface for recording. Accordingly, there is available at the surface a record of the pressure as a function of time at the source probe and each of the observation probes. There are various available devices and techniques for withdrawing fluid from the formations at substantially constant pressure; examples being set forth in U.S. Pat. Nos. 4,507,957 or 4,513,612.

If, based on measurements obtained during drawdown, it is desired to take fluid samples, the source probe is activated by opening valve **166*a*** and fluid is withdrawn from the formation for a given time or until a particular amount of fluid has been withdrawn. No flow rate measurement is made. Pressure measurements at the source probe as well as at the observation probes are taken during sampling, and these measurements are sent uphole as hereinbefore indicated with respect to the measurements made during drawdown.

Before turning to the methods of practicing the invention, an understanding of the underlying theory is desirable. To determine the pressure as a function of time (t) resulting from a withdrawal or injection of fluid when the rate of withdrawal (flowrate) is not constant, convolution is utilized. For the geometry of the tool shown in FIGS. 1 and 2, the pressure function is:

$$p_m(\Theta,z,t) = \int_0^t q_s(t-\tau)\, g(\Theta,z,\tau)\, d\tau \qquad (1)$$

where $p_m(\Theta,z,t)$ m is the measured pressure at a displacement of $(\Theta,z)$ from the sink, $q_s(t)$ is the flowrate at the sink, and $g(\Theta,z,\tau)$ is the pressure at $(\Theta,z)$ resulting from an instantaneous pulse of unit flowrate at the sink.

Applying a Laplace Transform to the pressure function of equation (1) yields:

$$p_m(\Theta,z,s)=q_s(s)\ g(\Theta,z,s) \tag{2}$$

where s is the Laplace Transform variable. Using equation (2), at the vertical observation probe where a equals zero:

$$p_m(0,z_v,s)=q_s(s)\ b(0,z_v,s) \tag{3}$$

and at the horizontal observation probe, where the vertical displacement equals zero, and $\Theta=\pi$ radians:

$$p_m(\pi,0,s)=q_s(s)\ g(\pi,0,s) \tag{4}$$

It should be appreciated that while 0 preferably equals $\pi$ radians, and vertical displacement equals zero for the horizontal observation probe, the method of the invention can be carried out with a horizontal observation probe otherwise located. Likewise, the vertical observation probe can be otherwise located.

Dividing the results of equation (3) by equation (4), and arranging the results in the Laplace domain, $$p_m(\Theta,z,s)=G(s)\ p_m(\pi,0,s) \tag{5}$$

where $$G(s)=q(0,z_v,s)/g(\pi,0,s) \tag{6}$$

Inverting equation (6) out of the Laplace domain yields the following relationship between the pressure at the horizontal and vertical probes:

$$p_m(0,z_v,t) = \int_0^t G(t-\tau)\ p_m(\pi,0,\tau)d\tau \tag{7}$$

It should be appreciated and stressed that G(t) is not a function of flowrate (and consequently storage). Thus, in equation (7) the relationship which expresses pressure at one of the observation probes is effectively a function of the pressure at the other observation probe. Flowrate, which is not easily measured, need not be measured. Only pressure, which can be easily and accurately measured need be measured. Additionally, it should be noted that the pressure at each of the observation probes is a function of the rate of fluid withdrawal at the sink and is independent of the pressure at the sink resulting from the fluid withdrawal. Therefore, the pressure at each of the observation probes, and hence G(t), will not be affected by events such as local skin, deviations from Darcy's law due to high flow velocities, and gas evolution, occurring in the immediate vicinity of the sink.

The function G(t) is a function of the geometry, rock, and fluid properties of the formation. The term "geometry" relates to the fact that a formation may be layered with different layers of different permeabilities, may be invaded to a greater or lesser extent, may be at a perpendicular or other angle relative to the borehole, may include or not include barriers, or may appear at certain locations to be essentially an infinite homogeneous system.

Because geometry affects the function G(t), it is desirable to determine the geometry of the formation in which the tool is located. While this information may be available from other tools known in the art, it may also be determined in accord with the techniques of the invention by deconvolution. In particular, using the equations set forth in Goode, P. A. and Thambynayagam, R. K. M.: "Analytic Models for a Multiple Probe Formation Tester," *SPE* 20737. 65th Ann. Tech. Conf. and Exhibition of the SPE, Houston, Tex. (1990) which is hereby incorporated by reference herein in its entirety, in an unbounded (i.e., effectively infinite) reservoir, a definition of G(s) can be determined as:

$$G(s) = (r_w/2Z_v)\exp[(-Z_v/r_w)\sqrt{(k_h/k_v)}\ \sqrt{s_D}\,]/F(s_D) \tag{8}$$

where $r_w$ is the radius of the wellbore, $z_v$ is the vertical displacement of the vertical probe relative to the source probe, $k_h$ and $k_v$ are respectively the horizontal and vertical permeabilities of the formation measured in darcies, and $s_D$ and $F(s_D)$ are functions defined by $$s_D=\phi\mu c_t s/k_h \tag{9}$$

where $\phi$ is the porosity of the formation, $\mu$ is the viscosity of the fluid in the formation, $c_t$ is the total compressibility (measured in $atm^{-1}$) of the formation, and $F(s_D)$ is defined by $$F_{(sD)} = (-1/\pi)\sqrt{k_h/k_v}\ \sum_{m=-\infty}^{\infty}\int_0^\infty [K_m(\sqrt{S_D+\alpha^2})/\ K_m'(\sqrt{S_D+\alpha^2})]d\alpha/\sqrt{S_D+\alpha^2} \tag{10}$$

In equation (10), $K_m$ is the m'th order modified Bessel function of the second kind, $K'_m$ is the first derivative of $K_m$, and $\alpha$ is the variable of integration.

As stated in the aforementioned article by Goode and Thambynayagam, with increasing flow time, both the horizontal and vertical observation probes will begin to experience spherical flow. Once this occurs, i.e., as time t approaches infinity (s approaches zero), equation (8) above can be reduced to:

$$\lim_{s\to 0} G(s) \sim (C_v-s)^{\frac{1}{2}}/(C_h-s)^{\frac{1}{2}} \sim (C_v/C_h) - [(C_h-C_v)/C_h^2]\sqrt{s} \tag{11}$$

where $C_h$ and $C_v$ are constants which depend upon the geometry and the formation and fluid properties. For the preferred tool of FIG. 1; $C_h$ and $C_v$ are defined by:

$$C_h = 0.2558\sqrt{\eta_h}\ /r_w \tag{12}$$

$$C_v = \sqrt{\eta_v}\ /Z_v$$

where $\eta_h$ and $\eta_v$ are respectively the horizontal and vertical diffusivities defined by:

$$\eta_i=k_i/\phi\mu c_t,\ i=h,v \tag{13}$$

with k being the permeability. Inverting equation (11) into the time domain (i.e., inverting the Laplace transform), as time t approaches infinity, the function G(t) can be found as $$\lim_{t\to\infty} G(t) \sim (C_h - C_v)/C_h^2 2t\sqrt{\pi t} \tag{14}$$

Therefore, if G(t) $*t^{1.5}$ is plotted as a function of time t, the resulting curve will asymptote (as t gets large) to a constant value.

Returning to the time domain over the entire period of fluid flow, it is more convenient when numerically deconvolving integral equations to extract the integral of the kernal. Thus, another function H(t) can be defined as:

$$H(t) = \int_o^t G(\Gamma)d\Gamma \tag{15}$$

using equations (11) and (15), as t approaches infinity (s approaches zero), $$H(s) = G(s)/s \sim (C_v/C_h)\,[(1/s) - ((C_h - C_v)/\sqrt{s}\ C_vC_h)] \tag{16}$$

which when inverted gives $$\lim_{t\to\infty} H(t) \sim (C_v/C_h) - (C_h - C_v)/\sqrt{\pi t}\ C_h^2 \tag{17}$$

From equation (17), it can be observed that if H(t) is plotted as a function of $t^{-\frac{1}{2}}$, that the curve will asymptote to a straight line where the slope is equal to $$(C_v - C_h)/\sqrt{\pi}\ C_h^2, \tag{17a}$$

and the intercept is equal to $$C_v/C_h. \tag{17b}$$

While equations (8) through (17*b*) apply to the unbounded reservoir, it is also useful to provide theory for a bounded system. In a bounded system, the pressure pulse will eventually hit the boundaries and cause both probes to experience radial flow. Therefore, at large times (t going to infinity), $$\lim_{s\to o} G(s) \sim (D_v - \log s)/(D_h - \log s) \tag{18}$$

where $D_h$ and $D_v$ are constants which depend upon the geometry and the formation and fluid properties and are defined by $$D_h = (r\pi k_h h/\mu)\Delta p_h^*(t) - \log(t) - \Gamma \tag{18a}$$

$$D_v = (r\pi k_v h/\mu)\Delta p_v^*(t) - \log(t) - \Gamma \tag{18b}$$

where $\Delta p_h^*(t)$ and $\Delta p_v^*(t)$ are the pressure responses at the horizontal and vertical probes, respectively for a constant unit flow rate at the sink probe, and are calculable using equation (A5) of the previously incorporated article by Goode and Thambynayagam; h is the thickness of the layer of the bounded system (i.e., the distance between the boundaries); and Γ is Euler's constant 0.577215664 . . . .

When inverted, equation (18) gives $$\lim_{t\to\infty} G(t) \sim [(D_h - D_v)/tY^2][1 - (\pi^2/2Y^2) - 8\beta(3)/Y^3 - \ldots \tag{19}$$

where $Y = \log t + D_h + \Gamma$, and $$\beta(3) = \sum_{n=1}^{\infty} 1/n^3 = 1.20205\ldots \tag{19a}$$

The time integral of G(t) is $$\lim_{t\to\infty} H(t) \sim 1 - (D_h - D_v)[(1/Y) + (\pi^2/6Y^3) + 2\beta(3)/Y^4 - \ldots] \tag{20}$$

It can be seen from equation (20) that a characteristic of radial flow is that H(t) approaches the value one asymptotically. Using just the first two terms of equation (20), when $[1-H(t)]^{-1}$ is plotted against log t, it will asymptote to a straight line with a slope equal to $$1/(D_h - D_v) \tag{20a}$$

and an intercept of $$(D_h + \Gamma)/(D_h - D_v) \tag{20b}$$

Because $D_h$ and $D_v$ are functions of the distance between the relative probe positions and the formation boundaries as discussed in the previously incorporated article by Goode and Thambynayagam, as well as functions of the permeability, the permeabilities and horizontal diffusivity can be obtained provided that probe positions relative to the boundaries are known from another source; e.g., the Formation MicroScanner (a registered trademark of Schlumberger Technology Corporation) tool disclosed in Eckstrom, M. P. et al., "Improved Imaging with Extended Microelectrical Scanning Arrays"; *The Log Analyst,* V.28. pp 294–306 (1987).

Figure 3:
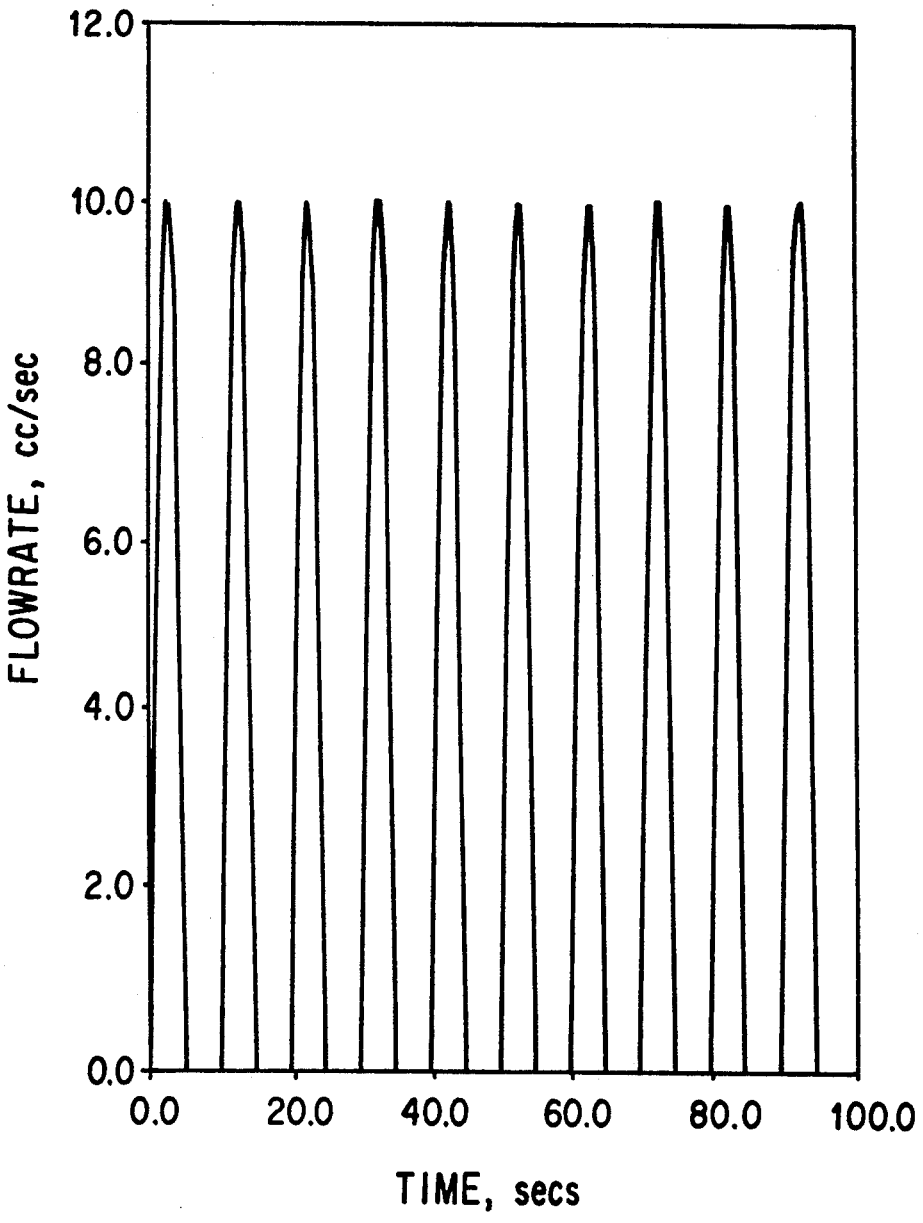
FIG. 3 is a graph of a synthetic flowrate at a source probe.
Figure 4:
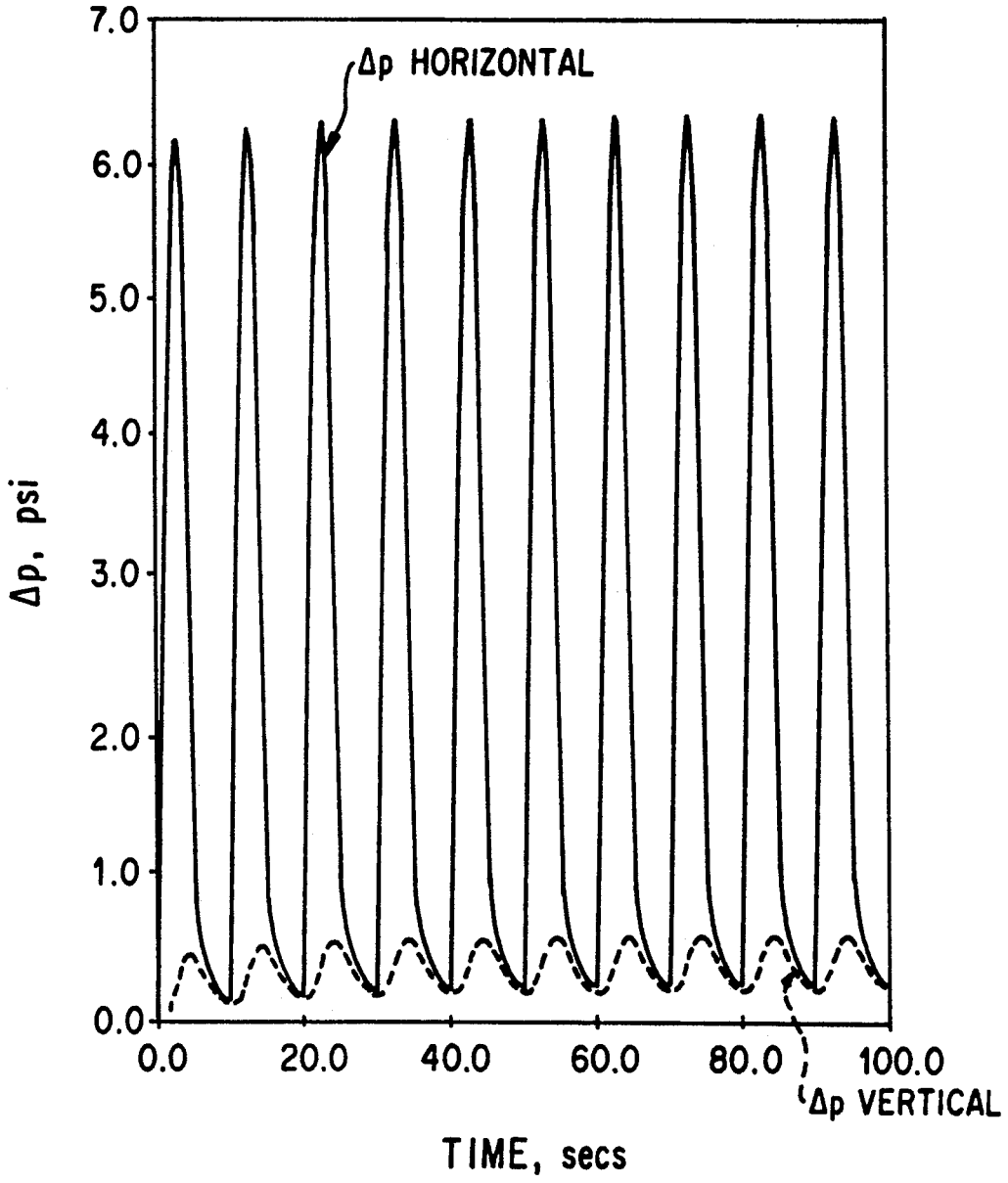
FIG. 4 is a graph showing the pressure at vertical and horizontal probes located in an unbounded formation in response to the flowrate of FIG. 3.
Figure 5:
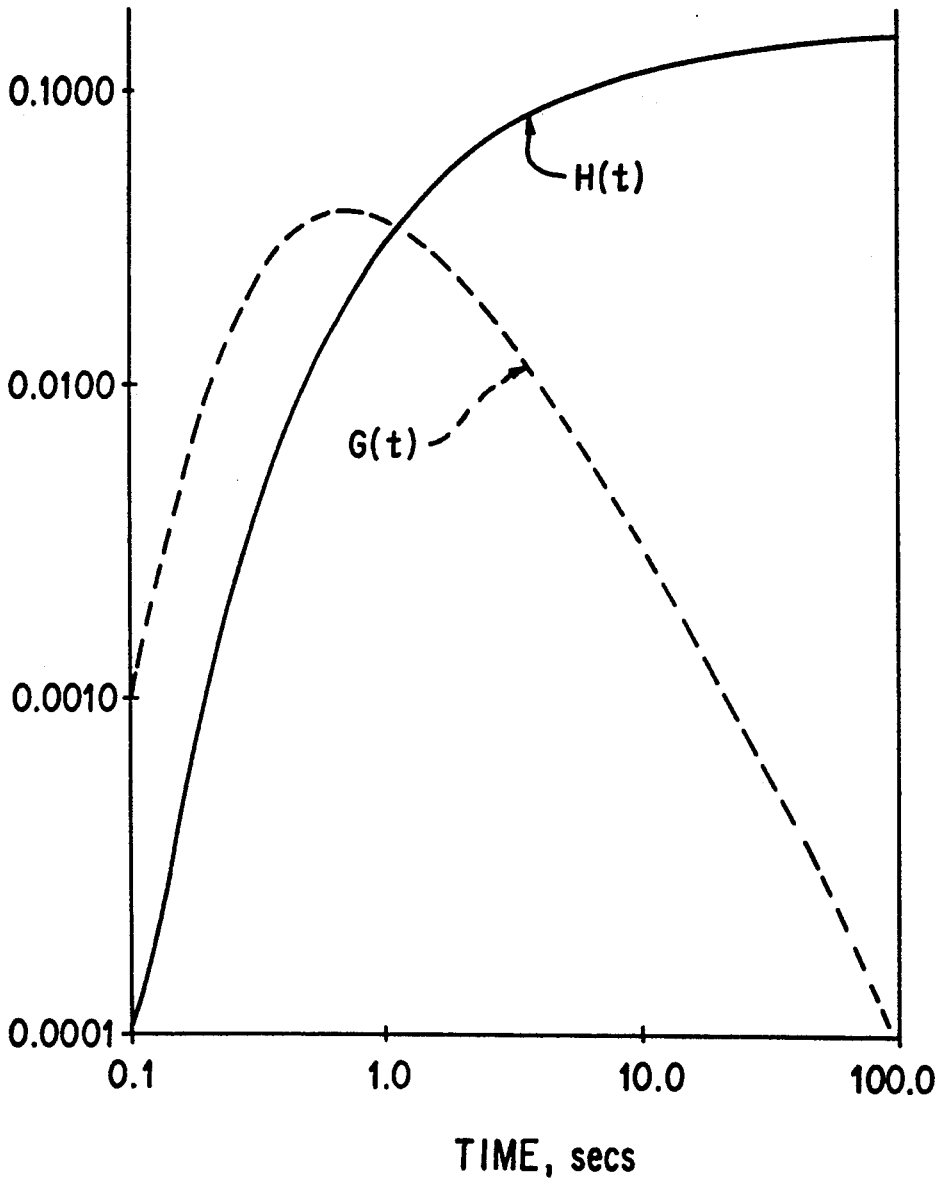
FIG. 5 is a graph of H(t) and G(t) for the unbounded formation based on the measured pressures of FIG. 4.
Figure 6:
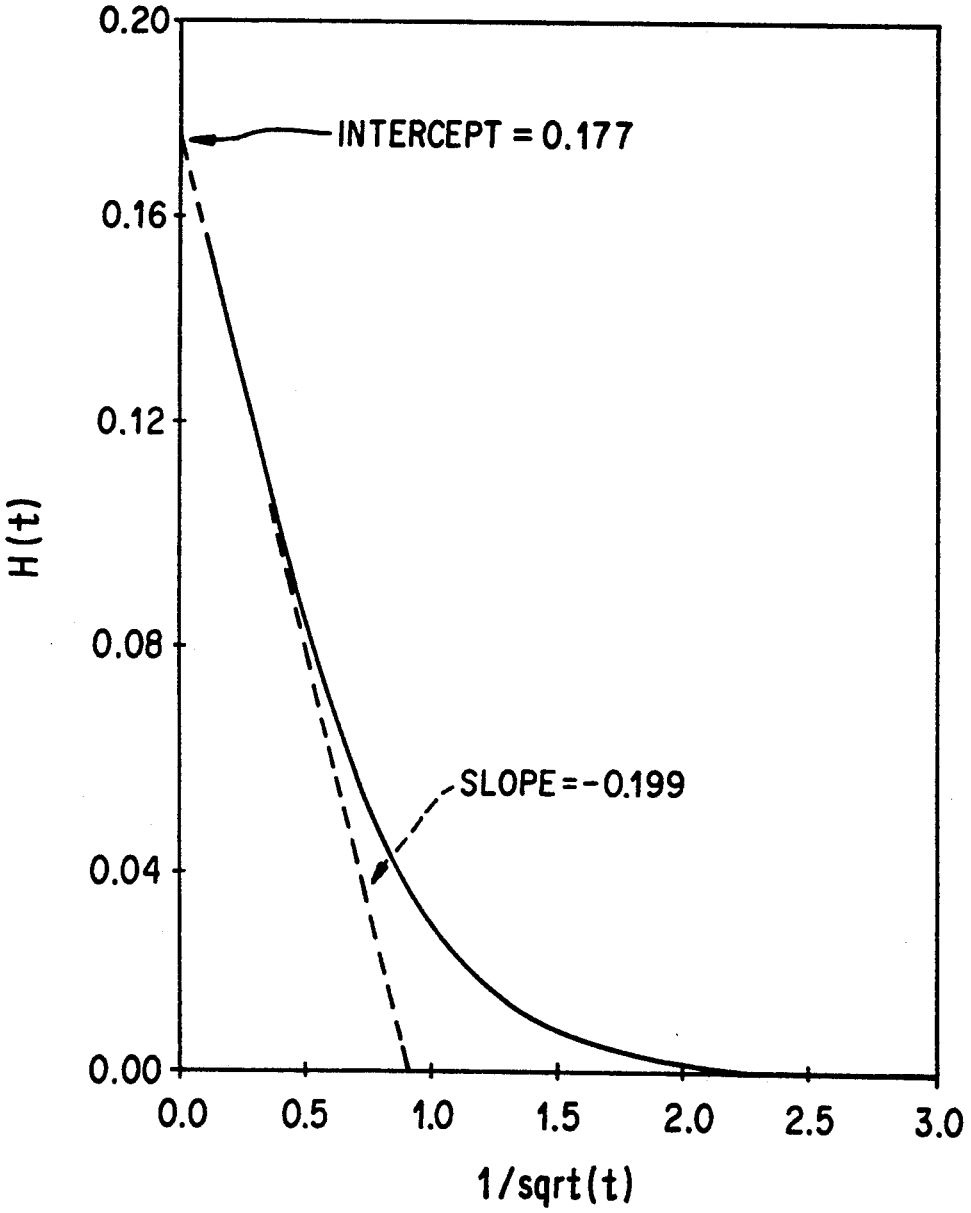
FIG. 6 is a graph of a function of H(t) for the unbounded formation based on the measured pressures of FIG. 4.

Returning to, and using the theory for the unbounded spherical flow example, a rapidly varying flowrate as seen in FIG. 3 was assumed. Using a computer model of the tool of FIGS. 1 and 2, assumed vertical and horizontal permeabilities of 10 and 100 millidarcies, assumed wellbore radius of ten centimeters, assumed viscosity of 0.8 cp, assumed porosity of 0.2, assumed total compressibility of $5\times10^{-6}$ psi$^{-1}$, assumed maximum volumetric fluid withdrawal rate of 10 cm$^3$/S, and assumed probe separation distance of 70 cm, resulting pressure responses for the horizontal and vertical observation probes were calculated as shown in FIG. 4. Then, using deconvolution methods as described in F. J. Kuchuk et al., "Deconvolution of Wellbore Pressure and Flow Rate"; *SPEFE,* March (1990) pp. 53–59, and in accord with equations 7 and 15, G(t) and H(t) were calculated and plotted as shown in FIG. 5. Also, as seen in FIG. 6, H(t) was plotted against $t^{-\frac{1}{2}}$. From FIG. 6, it can be seen that the intercept equals 0.177, and the slope equals −0.199. Using equations (12), (13), (17*a*) and (17*b*), and the slope and intercept as found, the horizontal diffusivity $\eta_h$ was calculated to be 8325 cm$^2$sec$^{-1}$, while the anisotropy or permeability ratio $k_h/k_v$ was calculated to be approximately 10.0; which calculations agree well with the input values. Thus, it is shown that the anisotropy and horizontal diffusivity of the formation are determinable without any knowledge of the flowrate.

Figure 7:
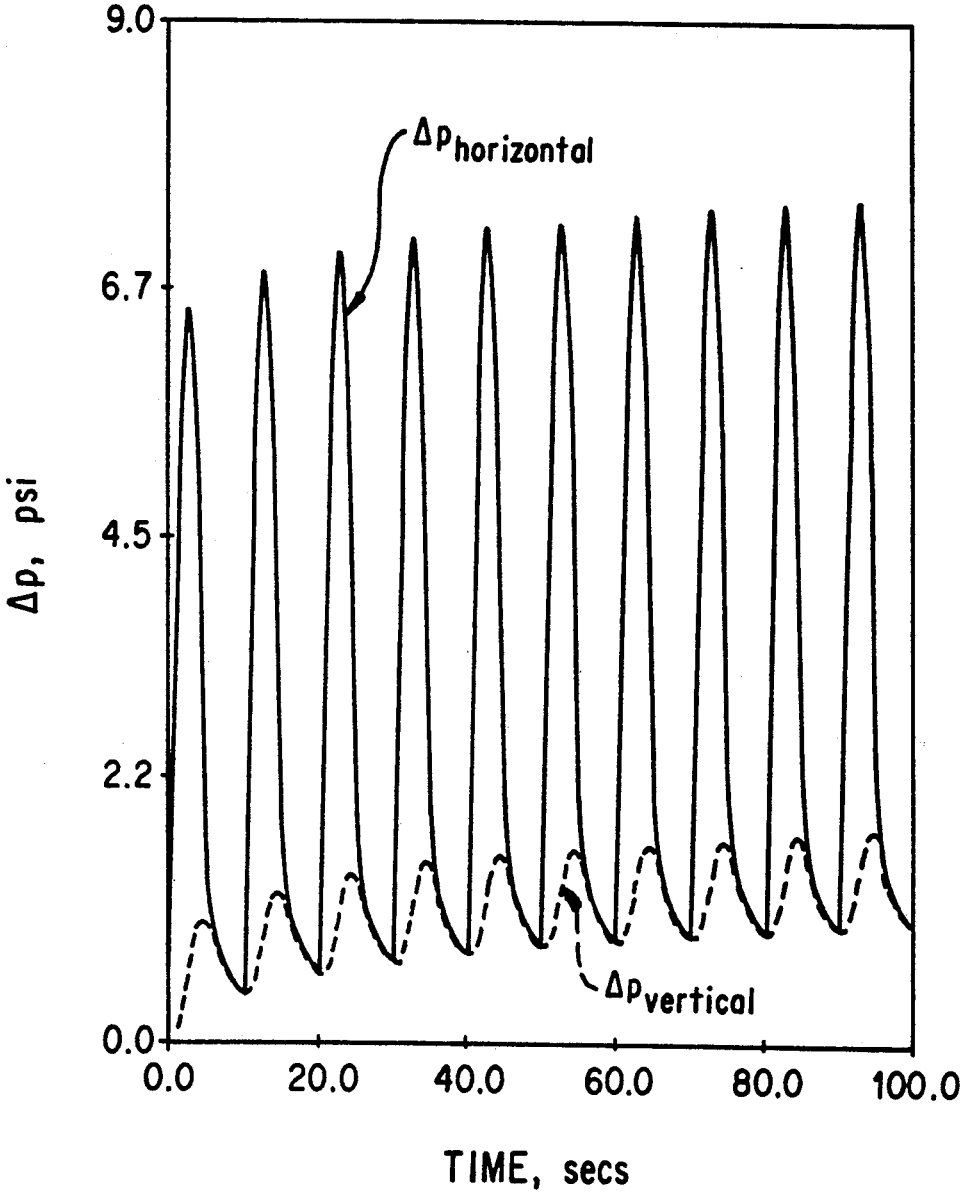
FIG. 7 is a graph showing the pressure at vertical and horizontal probes located in a layered formation in response to the flowrate of FIG. 3.
Figure 8:
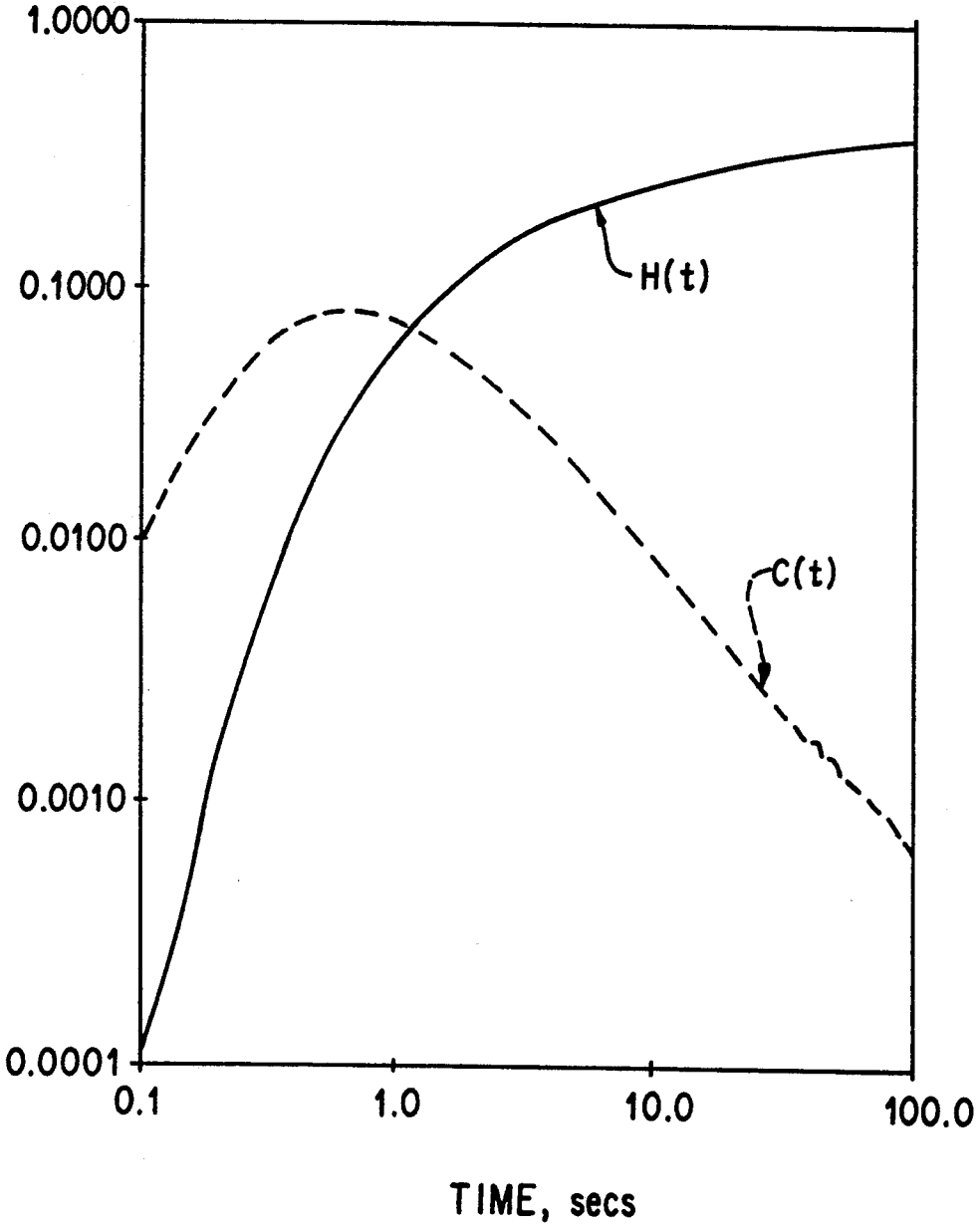
FIG. 8 is a graph of H(t) and G(t) for the layered formation based on the measured pressures of FIG. 7.
Figure 9:
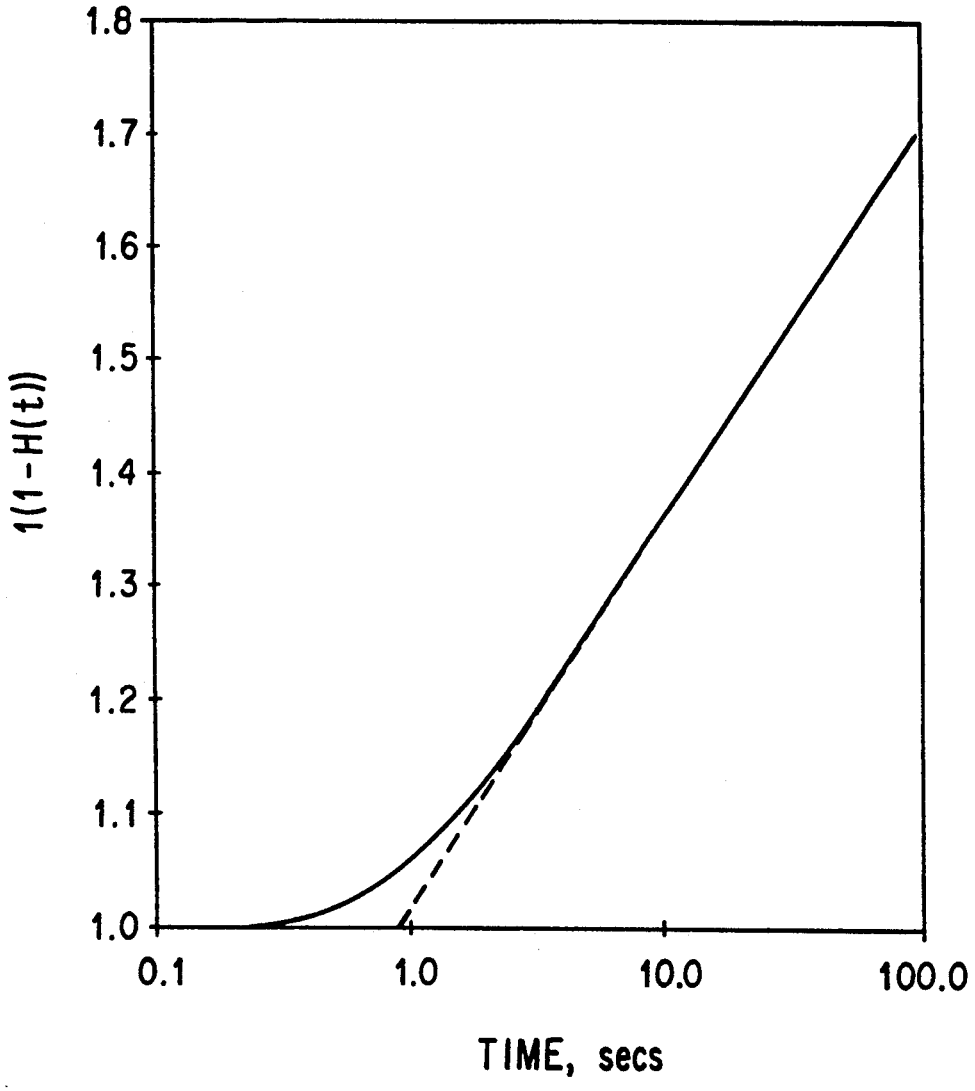
FIG. 9 is a graph of a function of H(t) for the layered formation based on the measured pressures of FIG. 7.

Returning to, and using the theory for the bounded radial flow example, and assuming the formation parameters and fluid properties previously presented with reference to the unbounded spherical flow example, except that two impermeable barriers are added one meter apart, with a first barrier being 20 cm below the horizontal probe, and the second being ten cm above the vertical probe, the pressures shown in FIG. 7 were generated for the flow of FIG. 3. With the pressures of FIG. 7, the function G(t) and H(t) were calculated as seen in FIG. 8, and the function $[1-H(t)]^{-1}$ is plotted versus the log of time (log t) in FIG. 9. From FIG. 9, a slope of approximately 0.1482 and an intercept of approximately 1.01 is found. Using equations (20*a*) and (20*b*), values for $D_h$ and $D_v$ are thereby derived with $D_h$ approximately equal to 6.315, and $D_v$ approximately equal to −0.433. From these values, using 20a and 20*b* to determine $D_h$ and $D_v$ and then using equations (18*a*) and (18*b*) in a minimization sense, the horizontal permeability is found to equal 125 millidarcies, and the vertical permeability 12.1 millidarcies. These determinations are within 25% of the actual (assumed) values, and show good agreement given that only the first two terms of the expansion were used in equation (20). If the full expression of equation (20) were used, the error would be considerably smaller (i.e., approach zero).

Figure 10:
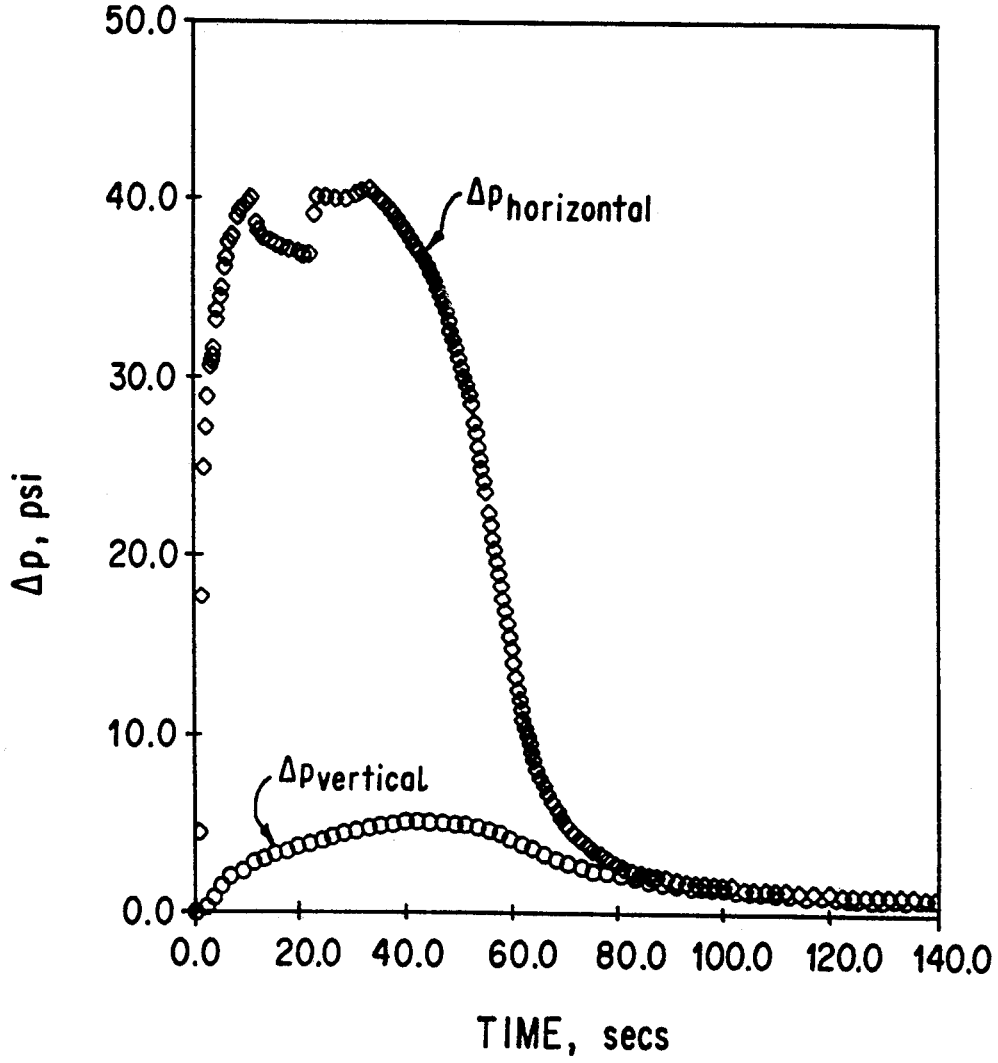
FIG. 10 is a graph showing actual measured pressures at vertical and horizontal probes utilizing the tool of FIG. 1 in a borehole.
Figure 11:
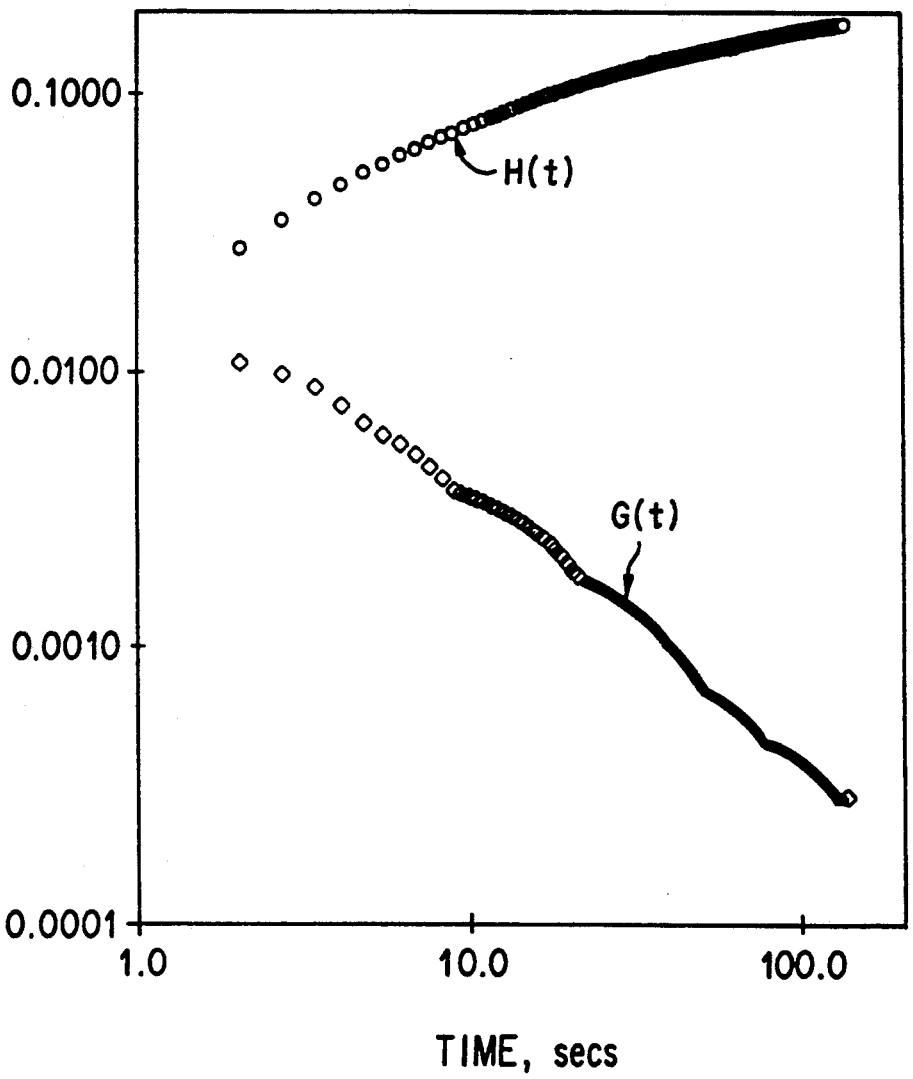
FIG. 11 is a graph of H(t) and G(t) which is derived from the measured pressures of FIG. 10.
Figure 12:
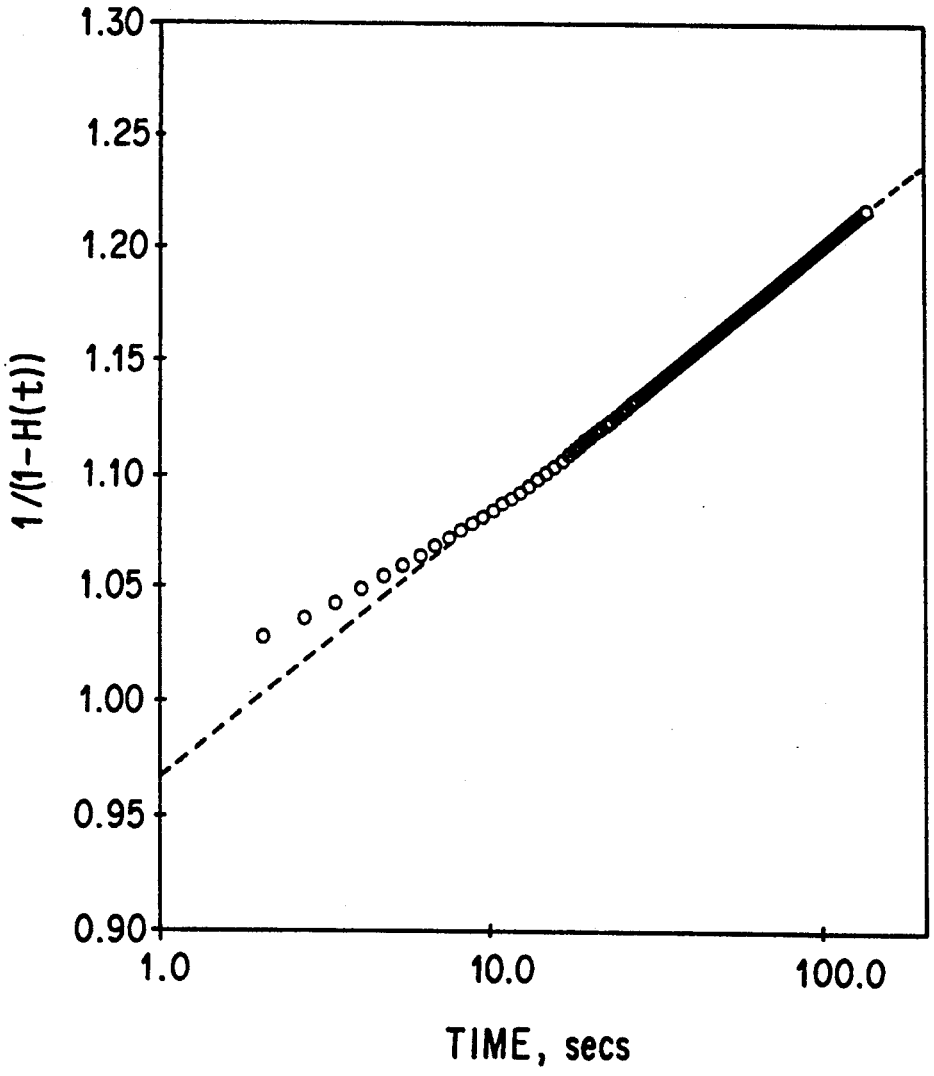
FIG. 12 is a graph of a function of H(t) for the formation tested based on the measured pressures of FIG. 10.

Turning to FIG. 10, results of actual data collected during a field test of the tool of FIGS. 1 and 2 are shown. In the field test, pressure changes were generated by opening a sample chamber, originally at atmospheric pressure, so that reservoir fluid could flow in. The flowrate during the test was not measured. The resulting G(t) and H(t) are shown in FIG. 11 plotted as function of time t. Other information gathered during the test indicated that the test was performed in a section of a reservoir which was bounded by impermeable barriers. This information is confirmed by plotting $[1-H(t)]^{-1}$ vs. log t as seen in FIG. 12. In FIG. 12, it is seen that the plot asymptotes to a straight line with a slope of 0.0504 and an intercept of 0.967. Using these values, it was determined that $D_h$ is approximately equal to 18.62 and $D_v$ is approximately equal to −1.232. With the knowledge that the distance from the horizontal probe to the lower boundary is approximately 1.2 meters, and the layer thickness is approximately 2.4 meters, a determination, via minimization as discussed below with reference to FIG. 13., provided a horizontal permeability of 112 millidarcies and a vertical permeability of 7.6 millidarcies.

Figure 13:
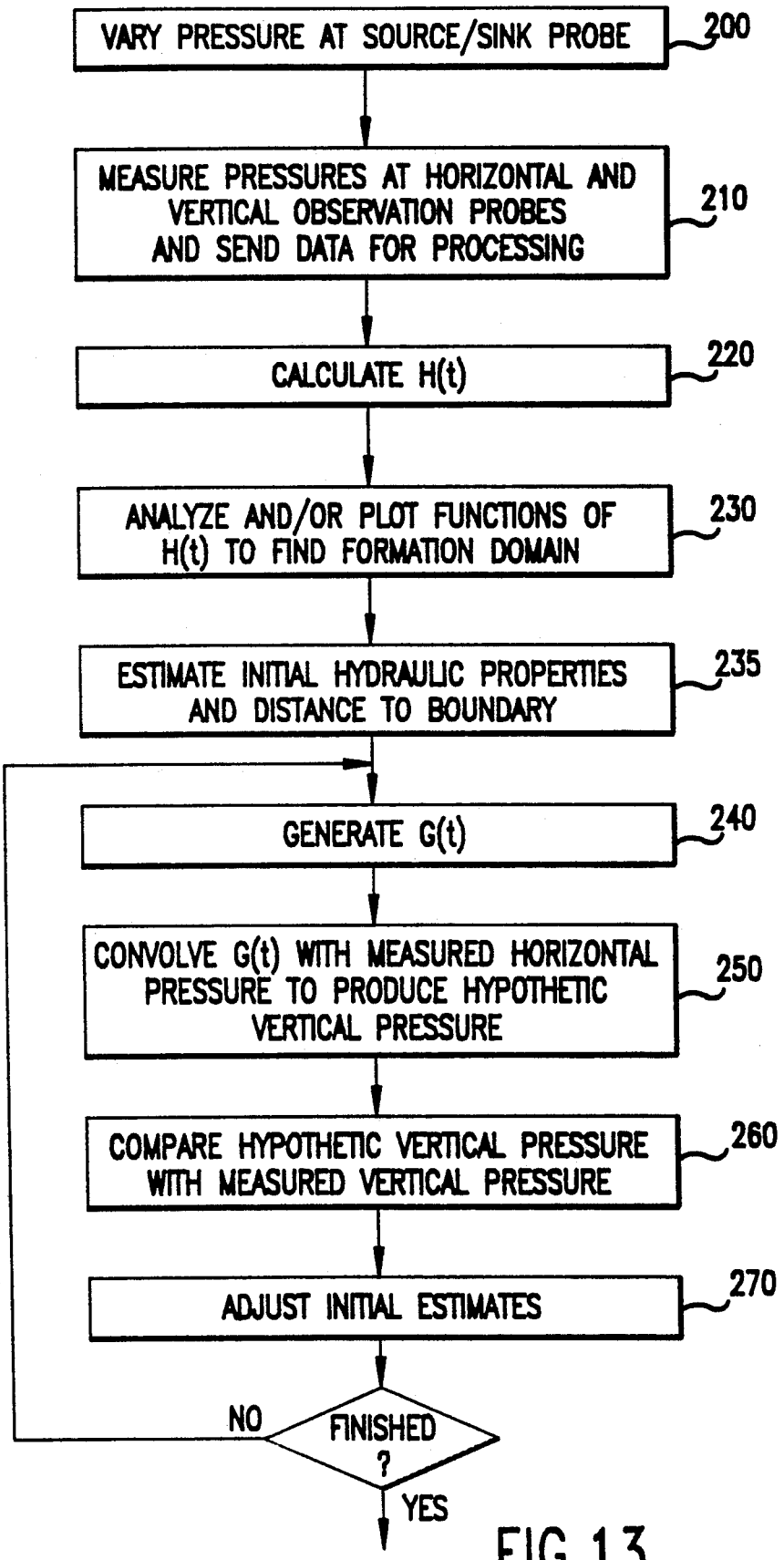
FIG. 13 is a flow chart of the steps of the method invention for determining hydraulic properties of a formation.

The preferred method for accurately determining a hydraulic property of a formation surrounding a borehole is seen in FIG. 13. With the borehole tool downhole, at step 200 the pressure at the sink probe of a borehole tool is varied, and as a result, either a fluid is injected into the formation, or formation fluids are drawn into the tool from the formation. While there is a pressure difference, at step 210 the pressure at the observation probes of the borehole tool which are vertically and horizontally displaced from the sink probe are measured. There is no need to measure the flow rate of the fluid entering or exiting the tool. The pressure information, gathered over time and sent to the borehole surface, is then used to determine a value for the hydraulic properties. In particular, from the measured pressures at the observation probes, by applying deconvolution methods to equation (7) and integrating using equation (15), at 220 values of functions of H(t) are calculated and are analyzed to find whether the functions asymptote to particular values. For example, functions of H(t) as set forth in equations (17) and (20) (such as H(t) vs. $t^{-\frac{1}{2}}$ or $[1-H(t)]^{-1}$ vs. log t), are analyzed and/or plotted to find whether they asymptote to a value. Based on the analysis of the H(t) functions, the domain (e.g., radial or spherical flow) in which the borehole tool is located is determined at 230, and at 235, based on the slope and intercept of the H(t) function, initial values for hydraulic properties are estimated. Of course, if other information regarding the type of formation in which the borehole tool is located is available, the analysis of H(t) can be limited to step 235 of finding initial estimates for hydraulic properties based on the slope and intercept of the H(t) function and the quality of data confirmed by comparison of the determined flow geometry with data obtained from an independent source (e.g., the Formation MicroScanner). Regardless, the determination at step 235 is based partially on supposed distances to boundaries (if any) in the formation. The initial boundary information is typically obtained via information from different borehole tools. It is also possible to determine the distances to the boundaries at the same time as finding the diffusivities by an automated minimization procedure employing four variables: the horizontal and vertical diffusivities; the distance from the source probe to the bottom boundary, and the thickness of the layer. However, the quality of the estimates is improved if one or more of the variables (e.g., the layer thickness) can be fixed via an independent source.

Using the hydraulic property and boundary distance estimates, at step 240, G(t) is generated by taking the Laplace transform of equation (A5) of the previously incorporated Goode and Thambynayagam article, and then inverting to get G(t). More particularly, using the Laplace Transform of (A5), and using the estimated values for the parameters, the righthand side of equation (6) is generated. Then, G(s) is inverted to give G(t). Then, according to equation (7), G(t) is convolved at step 250 with the measured horizontal pressure to produce a hypothetical vertical pressure. At 260, the hypothetical vertical pressure is compared with the measured vertical pressure by taking the differences between the two, squaring the differences, and summing the squared differences together. Based on the sum of the squared differences, at 270, the values for the hydraulic properties of the formation as well as the distances to the boundaries are adjusted. Steps 240 through 270 are repeated until the sum of the squared differences is less than a desired threshold value, or until a minimum is obtained. Least square procedures may be carried out using any of numerous algorithms and software; e.g., Marquardt, D., "An Algorithm for Least-Squares Estimation of Nonlinear Parameters; *SIAM Journal on Appl. Math,* V.11, pp. 431–441 (1963).

There have been described and illustrated herein methods for determining hydraulic properties of formations surrounding a borehole. While particular embodiments of the invention have been described, it is not intended that the invention be limited thereby, as it is intended that the invention be as broad in scope as the art will allow. Thus, it is understood by those skilled in the art that while particular formation models such as an unbounded reservoir with spherical flow and a bounded reservoir with radial flow have been provided and are used in finding the values for hydraulic properties, it will be appreciated that different formation models could also be utilized effectively. Similarly, different unbounded and bounded reservoir models could also be used. Also, while in the preferred embodiment, G(t) is convolved with the measured horizontal pressure to find a hypothetical vertical pressure, it will be appreciated that by solving the system differently, a different G(t), which is still based on the hydraulic properties of the formation could be convolved with the vertical pressure to find a hypothetical horizontal pressure. The hypothetical horizontal pressure could then be compared with the measured horizontal pressure, and the parameters adjusted until a minimum difference was obtained. Further, it will be appreciated that while the method invention is preferably carried out with the particularly disclosed borehole tool, it can be carried out in conjunction with different borehole tools, provided a sink (or source) is provided with any number of vertically and horizontally displaced pressure sensors on the tool. In fact, although not preferred, the invention can be carried out with the sink or source, and two horizontally, or two vertically displaced sensors at different positions. Of course, additional pressure sensors, either vertically and/or horizontally displaced relative to the source/sink can also be utilized for additional information. Furthermore, the method can be practiced using pressure measurements obtained by the borehole tool during pretest, drawdown, sampling . . . , or during a fluid injection procedure, or any combination thereof. Therefore, it will be appreciated by those skilled in the art that yet other modifications could be made to the provided invention without deviating from its spirit and scope as so claimed.

I claim:

1. A method for determining a hydraulic property of a formation surrounding a borehole by using a borehole tool having a first probe for injecting fluid into a formation or obtaining fluid from the formation, a second probe vertically displaced relative to the first probe and in fluid contact with said formation, and a third probe azimuthally displaced relative to the first probe and in fluid contact with said formation, said method comprising:

a) with said borehole tool in said borehole, varying the pressure at said first probe of said borehole tool;

b) measuring pressures at said second and third probes resulting from the varying of pressure at said first probe, wherein $p_m(0,z_v,t)$ is the pressure measured over time (t) at said second probe, and $p_m(\pi,0,\tau)$ is the pressure measured at instants $\tau$ at said third probe,;

c) utilizing the pressures measured at said second and third probes to determine values over time a of a function G(t) which is a function of the geometry and rock and fluid properties of the formation but is independent of the manner in which the pressure is varied at said first probe, wherein said function is related to the hydraulic property of said formation, and said pressures measured at said second and third probes are related to said function according to a first relationship $$p_m(0, z_v, t) = \int_0^t G(t-\tau)\, p_m(\pi, 0, \tau)d\tau.$$

2. A method according to claim 1, further comprising:

finding H(t) according to a second relationship $$H(t) = \int_o^t G(\Gamma)d\Gamma,$$

where H(t) is a second function of said geometry and rock and fluid properties of the formation.

3. A method according to claim 2, wherein:

H(t) is found by extracting the integral of the kernal of said first relationship.

4. A method according to claim 2, wherein:

H(t) is found by deconvolving said first relationship to obtain a value for G, and integrating G over time according to said second relationship.

5. A method according to claim 2, further comprising:

comparing at least one function of H(t) to at least one function of time to determine whether said function of H(t) asymptotes over time to a straight line.

6. A method according to claim 5, wherein:

said function of H(t) is H(t), and said function of time is $t^{-\frac{1}{2}}$, and if H(t) asymptotes to a straight line when compared to $t^{-\frac{1}{2}}$, assigning an intercept value of $C_v/C_h$ to an intercept of said straight line, said intercept being the value of H(t) as $t^{-\frac{1}{2}}$ approaches zero, and assigning a slope value $$(C_v - C_h)/\sqrt{\pi}\, C_h^2$$

to the slope of said straight line, where $C_v$ and $C_h$ are values which depend upon the geometry and the formation and fluid properties.

7. A method according to claim 6, wherein:

$C_h$ is defined substantially according to $$C_h = .2558\sqrt{\eta_h}\; r_w$$

where $\eta_h$ is the horizontal diffusivity of said formation, and $r_w$ is the radius of said borehole, and $C_v$ is defined substantially according to $$C_v = \sqrt{\eta_v}\;/z_v$$

where $\eta_v$ is the vertical diffusivity of said formation, and $z_v$ is the vertical displacement of said second probe relative to said first probe.

8. A method according to claim 7, wherein:

$\eta_h$ is defined according to $\eta_h = k_h/\phi\mu c_t$ and $\eta_v$ is defined according to $\eta_v = k_v/\phi\mu c_t$ where $k_h$ and $k_v$ are respectively the horizontal and vertical permeabilities of said formation, $\phi$ is the porosity of said formation, $\mu$ is the viscosity of the fluid in the formation, and $c_t$ is the total compressibility of said formation.

9. A method according to claim 5, wherein:

said function of H(t) is $[1-H(t))]^{-1}$, and said function of time is log t, and if $[1-H(t)]^{-1}$ asymptotes to a straight line when compared to log t, assigning an intercept value $(D_h+E)/(D_h-D_v)$ to an intercept of said straight line, said intercept being the value of log t as $[1-H(t)]^{-1}$ approaches one, and assigning a slope value $1/(D_h-D_v)$ to the slope of said straight line, where $D_h$ and $D_v$ are values which depend upon distances between said second and third probes and boundaries in said formation, and E is Euler's constant.

10. A method according to claim 9, wherein:

$D_h$ and $D_v$ are defined substantially according to $$D_h=(r\pi k_h h/\mu)\Delta p_h^*(t)-\log(t)-\Gamma \text{ and}$$

$$D_v=(r\pi k_v h/\mu)\Delta p_v^*(t)-\log(t)-\Gamma$$

where $\Delta p_h^*(t)$ and $\Delta p_v^*(t)$ are respectively the pressure responses at said third and second probes for a constant unit flow rate at said first probe, h is the thickness of the layer of said formation being measured by said borehole tool and defined by said boundaries, $k_h$ and $k_v$ are respectively the horizontal and vertical permeabilities of said formation at said layer of said formation, r is the radius of said borehole, and $\mu$ is the viscosity of the fluid in the formation layer.

11. A method according to claim 5, further comprising:

comparing at least two functions of H(t) to at least two functions of time to determine layering properties of said formation.

12. A method according to claim 11, wherein:

H(t) is compared to $t^{-\frac{1}{2}}$, and $[1-H(T))]^{-1}$ is compared to log t to determine whether said borehole tool is in a radial flow domain or in a spherical flow domain.

13. A method according to claim 12, further comprising:

based on the flow domain in which said borehole tool is located, and based on said comparison of said function of H(t) to said function of time, finding values for the horizontal and vertical permeabilities of said formation at said layer of said formation.

14. A method according to claim 1, further comprising:

from said function G(t), determining said hydraulic property.

15. A method according to claim 14, further comprising:

plotting said hydraulic property as a function of borehole depth.

16. A method for determining a hydraulic property of a formation surrounding a borehole by using a borehole tool having a first probe for injecting fluid into a formation or obtaining fluid from the formation, a second probe vertically displaced relative to the first probe and in fluid contact with said formation, and a third probe azimuthally displaced relative to the first probe and in fluid contact with said formation, said method comprising:

a) with said borehole tool in said borehole, varying the pressure at said first probe of said borehole tool;

b) measuring pressures at said second and third probes resulting from the varying of pressure at said first probe, wherein $p_m(0,z_v,t)$ is the pressure measured over time (t) at said second probe, and $p_m(\pi,0,\tau)$ is the pressure measured at instants $\tau$ at said third probe;

c) convolving an estimated function with one of said pressures measured by said second and third probes to produce an estimated pressure at the other of said second and third probes, wherein said estimated function is generated by a model of said formation which includes the geometry and rock and fluid properties of the formation as input variables, but is independent of the manner in which the pressure is varied at said first probe;

d) comparing said estimated pressure at the other of said second and third probes to said pressure measured at the other of said second and third probes; and e) adjusting values for said properties of said formation in order to change values for said estimated function and reduce the difference between said estimated pressure at the other of said second and third probes and said pressure measured by said other of said second and third probes.

17. A method according to claim 16, wherein:

said function is convolved with said pressured measured by said third probe to provide an estimated vertical pressure at said second probe, and said estimated vertical pressure at said second probe is compared to said pressure measured at said second probe.

18. A method according to claim 17, wherein:

initial estimates for at least one of said input variables is obtained by using said pressures measured at said second and third probes, finding a first function G(t) according to $$p_m(0, z_v, t) = \int_0^t G(t-\tau)\, p_m(\pi,0,\tau)d\tau$$

finding H(t) according to a second relationship $$H(t) = \int_0^t G(\Gamma)d\Gamma,$$

comparing at least one function of H(t) to at least one function of time, and determining from said comparing step said at least one initial estimate.

19. A method according to claim 18, wherein:

said comparing step comprises comparing H(t) to $t^{-\frac{1}{2}}$ and/or comparing $[1-H(t))]^{-1}$ to log t to determine a slope value and an intercept value if said function of H(t) asymptotes to said function of time, wherein said slope value and said intercept value are functions of the vertical and horizontal permeabilities of said formation and the viscosity of the fluid in said formation.

20. A method according to claim 16, wherein:

said values for said properties are adjusted until said difference is minimized.

21. A method according to claim 16, wherein:

said plurality of properties of said formation include at least a hydraulic property estimate and at least one boundary distance estimate.

22. A method according to claim 16, wherein:

initial estimates for said input variables are obtained from previous information.

23. A method according to claim 16, wherein:

said hydraulic property is determined by adjusting said values until said difference is less than a predetermined threshold or until a minimum is found.

24. A method according to claim 23, further comprising:

plotting said hydraulic property as a function of borehole depth.

* * * * *